US005319378A

United States Patent [19]

Nalbandian et al.

[11] Patent Number: 5,319,378

[45] Date of Patent: Jun. 7, 1994

[54] MULTI-BAND MICROSTRIP ANTENNA

[75] Inventors: Vahakn Nalbandian, Ocean, N.J.; Choon S. Lee, Dallas, Tex.

[73] Assignee: The United States of America as represented by the Secretary of the Army, Washington, D.C.

[21] Appl. No.: 959,022

[22] Filed: Oct. 9, 1992

[51] Int. Cl.[5] ..... H01Q 1/38

[52] U.S. Cl. ..... 343/700 MS; 343/830

[58] Field of Search ..... 343/700 MS, 789, 772, 343/830; H01Q 1/38

[56] References Cited

U.S. PATENT DOCUMENTS 4,162,499 7/1979 Jones et al. ..... 343/700 MS
4,907,006 3/1990 Nishikawa et al. ..... 343/700 MS

OTHER PUBLICATIONS

D. H. Schaubert et al., "Some Conformal, Printed Circuit Antenna Designs," Proc. Workshop on Printed Circuit Antennas, New Mexico State University, pp. 5.1-5.21, Oct. 1979.

P. S. Hall et al., "Wide Bandwidth Microstrip Antennas for Circuit Integration," Electronic Letters, vol. 15, No. 15, pp. 458-460, 1979.

R. Q. Lee et al., "Characteristics of Two-Layer Electromagnetically Coupled Rectangular Patch Antenna," Electronic Letters, vol. 23, No. 20, pp. 1070-1072, 1987.

S. A. Long et al., "A Dual-Frequency Stacked Circular-Disc Antenna," *IEEE Transactions on Antennas and Propagation*, vol. AP-27, No. 2, pp. 270-273, Mar. 1979.

Y. T. Lo et al., "Theory and Experiment on Microstrip Antennas," *IEEE Transactions on Antennas and Propagation*, vol. AP-27, No. 2, pp. 137-145, Mar. 1979.

W. F. Richards et al., "An Improved Theory for Microstrip Antennas and Applications," *IEEE Transactions on Antennas and Propagation*, vol. AP-29, No. 1, pp. 38-46, Jan. 1981.

W. F. Richards et al., "A Simple Experimental Method for Separating Loss Parameters of a Microstrip Antenna," IEEE Transactions on Antennas and Propagation, vol. AP-29, No. 1, pp. 150-151, Jan. 1981.

C. S. Lee et al., "Dual-Band Microstrip Antenna with An Airgap," *IEEE Antennas and Propagation Society International Symposium*, 1992 Digest, vol. 1, pp. 479-482, Jul. 1992.

Kumar et al., "Nonradiating Edges and Four Edges Gap-Coupled Multiple Resonator Broad-Band Microstrip Antennas," IEE Transactions on Antennas and Propagation, vol. AP-33, No. 2, pp. 173-178, 1985.

*Primary Examiner*—Michael C. Wimer
*Attorney, Agent, or Firm*—Michael Zelenka; William H. Anderson

[57] ABSTRACT

A microstrip antenna capable of dual-frequency operation. The antenna comprises a microstrip having a thin, rectangular metal strip that is supported above a conductive ground plane by two dielectric layers which are separated by an air gap or other lower dielectric constant material. Conducting side walls and a rear wall extend between the ground plane and the strip. The ground plane, the strip, the walls and an opening at the front cooperate to form a rectangular resonant cavity. In essence, the cavity is surrounded by conducting surfaces except for the front opening and a small opening in the ground plane that accommodates an antenna feed. The front opening of the cavity functions as an antenna aperture through which the antenna transmits and/or receives energy. The antenna feed is a coaxial transmission line that provides a means for coupling the antenna to an external circuit. The spaced dielectric layers and the air gap produces higher-order modes which causes dual frequencies.

13 Claims, 4 Drawing Sheets

GHz
f1 = 2.7736
f2 = 2.7800
f3 = 2.7864
f4 = 3.0328
f5 = 3.0392
f6 = 3.0472

IMPEDENCE FOR ANTENNA WITH
a = 2.2cm, b = 1.7cm, c = 5.6cm, t = 0.7 cm, w = 3.9cm

GHz
f1 = 2.7848
f2 = 2.7880
f3 = 2.7928
f4 = 3.0360
f5 = 3.0440
f6 = 3.0536

IMPEDENCE FOR ANTENNA WITH
a = 2.0cm, b = 1.7cm, c = 5.8cm, t = 0.7 cm, w = 3.9cm

IMPEDENCE FOR ANTENNA WITH
a = 1.9cm, b = 1.7cm, c = 5.9cm, t = 0.75 cm, w = 3.9cm

RETURN LOSS VS. FREQUENCY FOR ANTENNA WITH
a = 1.9cm, b = 1.7cm, c = 5.9cm, t = 0.75 cm, w = 3.9cm

MULTI-BAND MICROSTRIP ANTENNA

GOVERNMENT INTEREST

The invention described herein may be manufactured, used and licensed by or for the Government for governmental purposes without the payment to us of any royalties thereon.

BACKGROUND OF THE INVENTION

1. Field of the Invention

This invention relates to microwave and millimeter wave microstrip antenna. More particularly, the invention relates to improved multi-band microstrip antennas.

2. Description of the Prior Art

Microstrip antennas have many well known advantages over conventional antennas. They have been used widely to replace conventional antennas in many applications where the lightweight, low-cost and low-profile characteristics of microstrip are important. There are, however, some drawbacks to the use of microstrip antennas. One of the most detrimental aspects of microstrip antennas that limits their use is their inherent narrow bandwidth. Consequently, many attempts have been made to increase their bandwidth.

A common technique for obtaining a larger bandwidth in a microstrip antenna is to place parasitic elements next to the radiating microstrip. This technique is discussed in detail by G. Kumar et al. in "Nonradiating Edges and Four Edges Gap-Coupled Multiple Resonator Broad-Band Microstrip Antennas," *IEEE Transactions on Antennas and Propagation*, Vol. AP-33, No. 2, pp. 173–178, 1985; and P. S. Hall et al. in "Wide Bandwidth Microstrip Antennas for Circuit Integration," *Electronic Letters*, Vol. 15, No. 15, pp. 458–460, 1979.

Another technique for obtaining a larger bandwidth is to vertically stack antennas into layered-microstrip configurations. This technique is discussed by R. Q. Lee et al. in "Characteristics of a Two-Layer Electromagnetically Coupled Rectangular Patch Antenna," *Electronic Letters*, Vol. 23, No. 20, pp. 1070–1072, 1987.

Both of the above-mentioned techniques do not always provide sufficient bandwidth when the operating frequencies are widely separated. Also, in many applications, only a few distinct frequency bands are needed rather than a continuous operating frequency range as is shown by S. A. Long et al. in "A Dual-Frequency Stacked Circular-Disc Antenna," *IEEE Transactions on Antennas and Propagation*, Vol. AP-27, NO. 2, pp. 270–273, Mar. 1979; and D. H. Schaubert et al. in "Some Conformal, Printed Circuit Antenna Designs," *Proc. Workshop on Printed Circuit Antennas*, New Mexico State University, pp. 5.1–5.21, Oct. 1979.

A major problem with multi-layered microstrip antennas is that their radiation patterns are usually severely degraded especially when their resonance frequencies are close together. Because of this problem, many two-frequency systems have been forced to use two separate microstrip antennas. Another important drawback of multi-layered microstrip antennas is that they are almost exclusively limited to two frequency bands. Production of these antennas in array form is often extremely difficult due to the multi-layer construction.

SUMMARY OF THE INVENTION

The general purpose of this invention is to provide a multi-band microstrip antenna that embraces all the advantages of currently employed devices and possesses none of the aforedescribed disadvantages. To attain this, the present invention contemplates a unique microstrip antenna having at least two distinct frequency bands with wide frequency separation. More specifically, the present invention is directed to a single-layer device that is as lightweight, low cost and low profile as a conventional microstrip antenna.

The antenna of the present invention can be used in a multi-frequency system without the necessity of having a plurality of separate antennas. Also, due to its single-layer construction, the present antenna can be easily arrayed using mass production techniques.

In general, the present invention is a multi-band microstrip antenna having a conductive ground plane, a plurality of dielectric layers with surfaces that are in contact with the ground plane. The dielectric layers are covered by a conductive shell having edges that contact the ground plane. The shell, ground plane and an opening at one end forms a multi-band resonant cavity. The opening forms an aperture for passing multi-band radiation. A cavity feed for injecting and extracting energy from the cavity is also provided.

In one specific embodiment, the invention is a microstrip patch antenna capable of dual-frequency operation. The antenna comprises a microstrip having a thin, rectangular metal strip that is supported above a conductive ground plane by two dielectric layers separated by an air gap. Conducting side walls extend between the ground plane and the metal strip to enclose the dielectric layers on all sides except for an area at the front end of the antenna that forms a rectangular opening. The ground plane, the metal strip, the side walls and the rectangular opening cooperate to form a resonant cavity. In essence, the cavity is surrounded by conducting surfaces except for the opening at its front end and a small opening in the ground plane that accommodates an antenna feed. The rectangular opening functions as an antenna aperture through which the antenna transmits and receives microwave and/or millimeter wave energy. The feed is a coaxial transmission line that provides a means for coupling the antenna to an external circuit.

The exact nature of this invention as well as other objects and advantages thereof will be readily apparent from consideration of the following specification relating to the annexed drawing.

DETAILED DESCRIPTION OF THE PREFERRED EMBODIMENT

Figure 1:
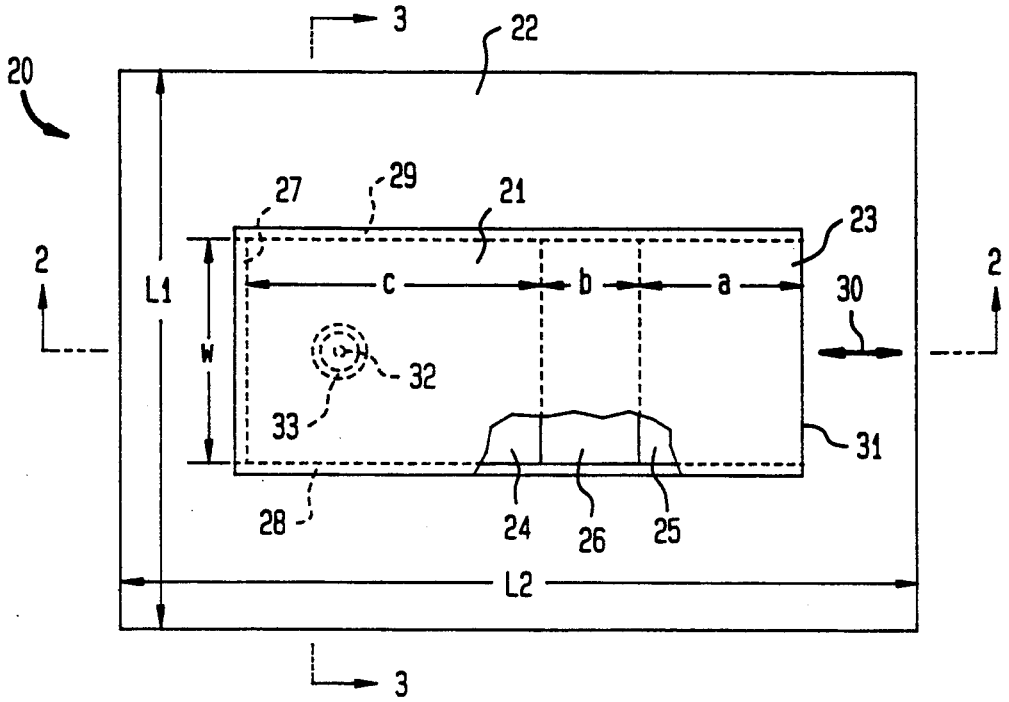
FIG. 1 is a top plan view with parts broken away of a preferred embodiment of the invention.
Figure 2:
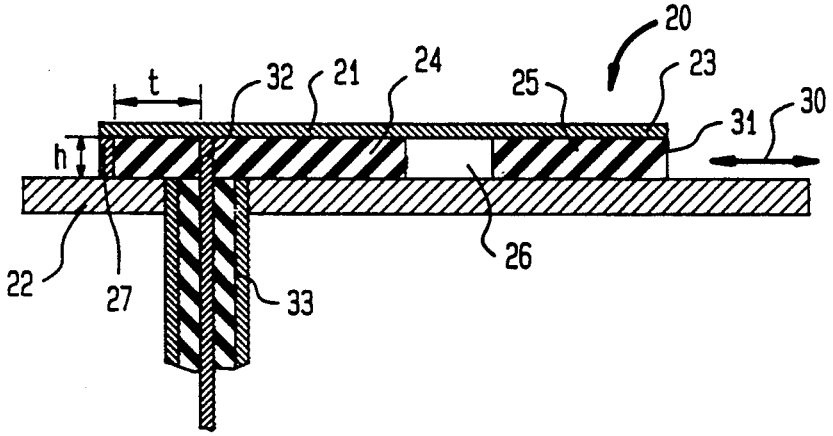
FIG. 2 is a side elevation of the preferred embodiment in cross section taken on the line 2—2 of FIG. 1 and looking in the direction of the arrows.
Figure 3:
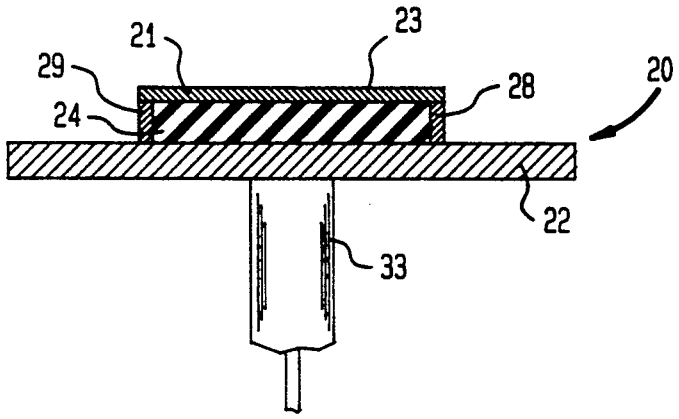
FIG. 3 is an end elevation of the preferred embodiment in cross section taken on the line 3—3 of FIG. 1 and looking in the direction of the arrows.

Referring now to the drawings, there is shown in FIGS. 1–3 a microstrip patch antenna 20 capable of dual-frequency operation. Antenna 20 comprises a microstrip 21 having a thin, rectangular metal strip 23 that is supported above a conductive ground plane 22 by two spaced dielectric layers 24, 25. An air gap 26 is located between the dielectric layers 24, 25. Layer 24 supports the rear portion of strip 23 while layer 25 supports the front portion of strip 23. In practice, strip 23 are thin coatings of copper on dielectric layers 24, 25.

Dielectric layers 24, 25 may be any suitable low-loss dielectric material. Air gap 26 may be replaced by other dielectric materials having dielectric constants that are lower than the dielectric constant of dielectric layers 24, 25. It is also noted that for illustration purposes the elements shown in FIGS. 1–3 are not drawn to scale. Illustrative examples showing the order of magnitude of the sizes of the elements are described below with respect to FIGS. 4–9.

A conducting rear wall 27 and conducting sidewalls 28, 29 extend between ground plane 22 and strip 23. Ground plane 22, strip 23, walls 27–29 and an opening 31 cooperate to form a rectangular resonant cavity. Opening 31 functions as an antenna aperture through which antenna 20 transmits and receives microwave and/or millimeter wave energy, as indicated by the double-headed arrows 30 in FIGS. 1, 2.

A cavity feed 32 includes a coaxial transmission line 33 having the end of its inner conductor extending through dielectric layer 24 and into contact with strip 23. The end of the outer conductor of line 33 is connected to ground plane 22. The inner conductor acts as a cavity probe which injects or extracts energy from the cavity. As such, transmission line 33 provides a means for coupling antenna 20 to an external circuit (not shown) in a manner well known to those skilled in these arts.

Several prototypes of antenna 20 were produced and tested. Test results for three prototypes are shown in FIGS. 4–9. Dielectric layers 24, 25 and strip 23 of all three prototypes were fabricated from two pieces of copper-clad Rogers Duroid 5880 with a dielectric constant of 2.2. In all cases, the Duroid pieces, which were 0.062 inch thick (see dimension (h)) with 0.001 inch thick copper cladding, were bonded to a rigid copper plate which was used to implement ground plane 22. Ground plane 22 had dimensions (L1) and (L2) (see FIG. 1) of 25.4 cm and 15.24 cm, respectively, and a thickness of 0.031 inch. In all cases, width (w) of strip 23 was 3.9 cm and length (b) of air gap 26 was 1.7 cm. Air gap 26 was bridged with a relatively thin copper strip that was soldered to the upper surfaces of the copper cladding of the Duroid pieces. Walls 27–29 were implemented with 3M 1181 copper-foil tape that was bonded to the sides of the Duroid pieces. Feeds 32 were implemented with a coaxial Omni Spectra probe of 50 ohms.

For the three tests, lengths (a) and (c) (see FIG. 1) of the Duroid pieces (dielectric layers 24, 25) were varied as was dimension (t) (see FIG. 2) which specifies the location of feed 32. The dimensions for the three prototypes are included in the drawings. The three prototypes are referred to herein as the FIG. 4 prototype, the FIG. 5 prototype and the FIG. 6 prototype.

The operation mechanism of antenna 20 may be best understood by using a cavity model. It is noted that microstrip thickness (h), which is 0.062 of an inch, is small compared to the wavelength. In accordance with the cavity model, microstrip antenna 20 can be considered a lossy resonating cavity defined on five surfaces by perfect electric conductors, i.e., ground plane 22, walls 27–29 and strip 23. A sixth surface is viewed as a perfect magnetic conductor, i.e., the opening 31 that forms the antenna aperture. As such, the cavity model is relatively simple and provides good physical insight.

The following papers discuss theories and calculations based on the use of a cavity model for a microstrip: Y. T. Lo et al., "Theory and Experiment on Microstrip Antennas," *IEEE Transactions on Antennas and Propagation*, Vol. AP-27, No. 2, pp. 137–145, Mar. 1979; W. F. Richards et al., "An Improved Theory for Microstrip Antennas and Applications," *IEEE Transactions on Antennas and Propagation*, Vol. AP-29, No. 1, pp. 38–46, Jan. 1981; and W. F. Richards et al., "A Simple Experimental Method for Separating Loss Parameters of a Microstrip Antenna," *IEEE Transactions on Antennas and Propagation*, Vol. AP-29, No. 1, pp. 150–151, Jan. 1981. The present invention is described in the following publication, which is incorporated herein by reference: C. S. Lee et al., "Dual-Band Microstrip Antenna with an Airgap,"*IEEE Antennas and Propagation Society International Symposium*, 1992Digest, Vol. 1, pp. 479–482, Jul. 1992.

The basic principle of dual-frequency operation in the present invention is to utilize a high-order mode in addition to the lowest-order mode. In a conventional rectangular microstrip antenna, the resonant frequencies are separated by fixed intervals to satisfy the boundary conditions for each corresponding normal mode. It has been found that these resonant frequencies can be shifted by replacing part of the dielectric material to form gaps of lower dielectric constant material, such as air gap 26. These frequency shifts are found to be more drastic when the two sides of the microstrip are shorted with electrically conducting surfaces, such as walls 28, 29.

In the present invention, width (w) is chosen so that the field distribution in the cavity is sinusoidal in the regions of dielectric layers 24, 25 and is exponential in the region of air gap 26. In this way resonant frequencies can be selected over a wide range of the frequency spectrum. In fact when air gap 26 is sufficiently large, the two lowest resonant frequencies become nearly degenerate.

If the two remaining edges are allowed to radiate, i.e., the front edge with opening 31 and a rear opening before wall 27 is installed, both symmetric and antisymmetric modes are excited in the cavity. The symmetric modes produce a broadside null in the far-field radiation pattern whereas the antisymmetric modes exhibit a broadside maximum. Since the most commonly used fundamental mode is antisymmetric, the symmetric modes must be eliminated. A quarter-wavelength microstrip, formed by mounting wall 27 at the rear edge, is used to eliminate the symmetric modes. As such, the resultant microstrip antenna 20 has three shorted edges, walls 27–29, and a fourth radiating edge, opening 31. Though the geometry is similar to a flat waveguide, antenna 20 is closer to a microstrip antenna in appearance and performance characteristics.

Once the desired resonant operating frequencies are obtained, impedance matching is considered for both frequencies. Changing the location of feed 32 may help to match the impedance for one frequency but may not help for the other frequency. However, as the location of air gap 26 shifts slightly, the impedances at the two resonant frequencies move considerably in opposite directions while the resonant frequencies remain relatively unchanged. Thus the proper choice of the location of air gap 26 and the size of dimension (b) provide impedance matching at the desired dual frequencies.

Figure 4:
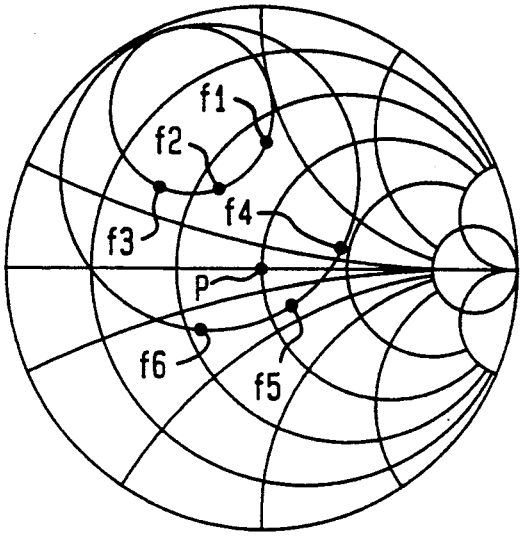
FIGS. 4–6 are Smith charts showing graphical representations of the impedances for three different prototype implementations of the antenna shown in FIGS. 1–3.
Figure 5:
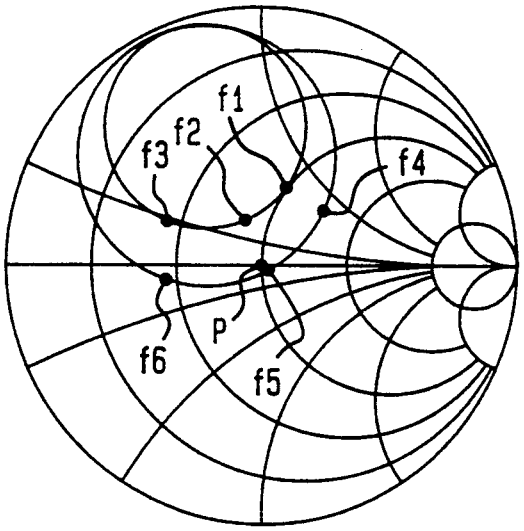
Figure 6:
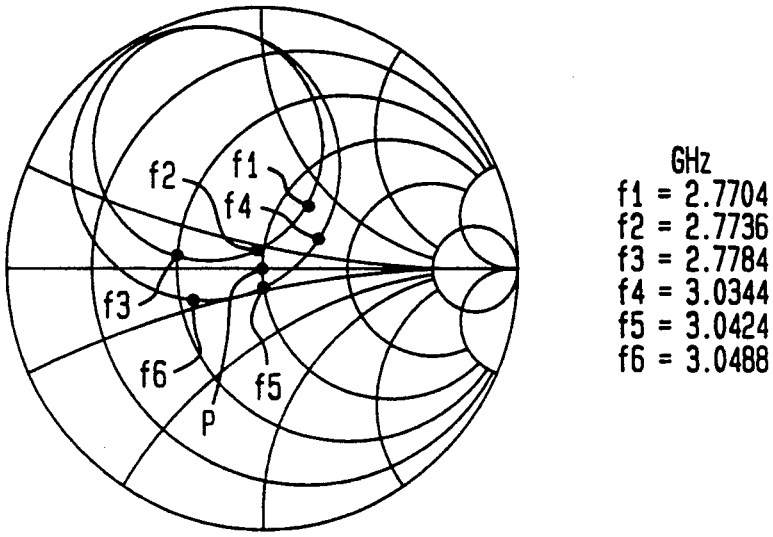

The impedances of the three prototypes constructed in accordance with the present invention are shown in the Smith charts of FIGS. 4–6. It is noted that the centers of the Smith charts are designated point (P), where perfect matching occurs. The center frequencies of the dual operating bands are designated f2 and f5. The frequencies of the band edges are designated fl, f3 for one band and f4, f6 for the second band.

Each Smith chart shows two distinct circular-type curves to indicate the double resonances of the prototypes. When air gap 26 is moved away from opening 31 by as little as 0.2 cm, i.e, from FIG. 4 (c=5.6 cm) to FIG. 5 (c=5.8 cm), the impedance loci shift toward each other, i.e., center frequencies f2 and f5 are shifted toward each other. In FIGS. 4, 5, the values of the two resonant center frequencies f2, f5 change less than 0.4%. Specifically, f2 changes from 2.7800 Ghz to 2.7880 Ghz while f5 changes from 3.0392 Ghz to 3.0440 Ghz.

In order to move the two impedances toward the center point (P) of the Smith chart so as to improve the VSWR, feed 32 was moved 0.05 cm closer to the opening 31 and air gap 26 was moved 0.1cm away from opening 31. Specifically, dimension (t), the location of feed 32, was increased from 0.70 cm in the FIG. 5 prototype to 0.75 cm for the FIG. 6 prototype, and dimension (c), the location of air gap 26, was increased from 5.8 cm to 5.9 cm. In FIG. 6 the two impedances for the center frequencies f2 and f5 are closer to the center point (P) in comparison to the curves of FIGS. 4, 5.

It is noted that the shift in the values of center frequencies f2, f5 is small as air gap 26 moves, and conversely, a small movement of the location of feed 32 causes a drastic change of the input impedance. This feature indicates that the input impedances can be matched at the desired dual frequencies by a proper selection of dimensions (a) and (t), i.e. the locations of air gap 26 and feed 32, respectively.

Figure 7:
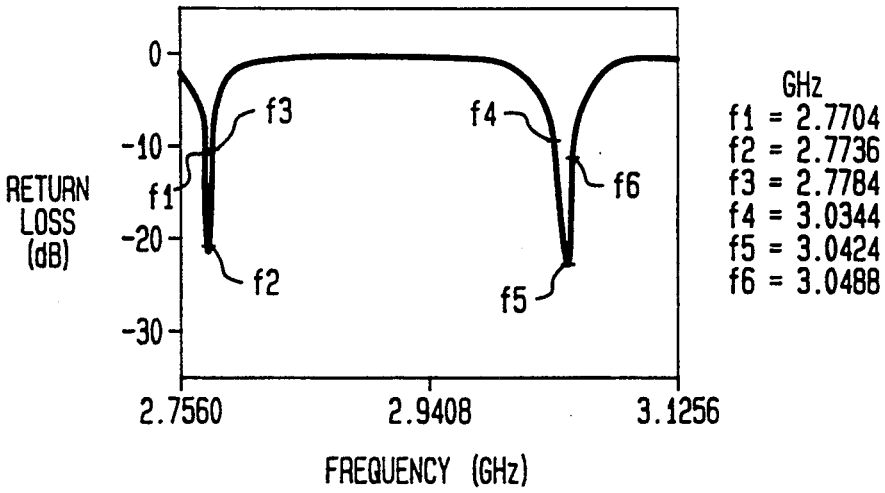
FIG. 7 is a graph showing return loss versus frequency for the prototype corresponding to FIG. 6.

A plot of the return loss versus frequency for the well-tuned FIG. 6 prototype is shown in FIG. 7, where the double resonances are clearly seen. Resonance frequencies that were computed using the cavity model were 2.829 Ghz and 3.081 GHz. The corresponding measured values (FIG. 7) were 2.774 GHz and 3.042 GHz. The corresponding input resonance resistances were computed to be 39.3 ohms and 63.8 ohms, respectively. These values correspond to VSWRs of 1.26 and 1.27, respectively.

Figure 8:
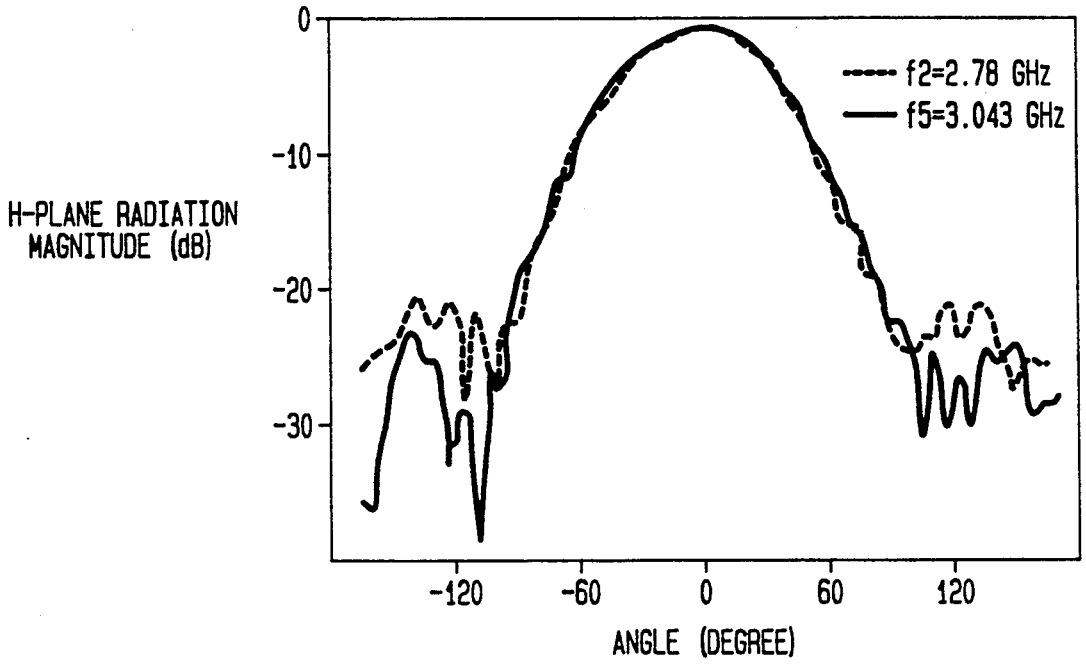
FIGS. 8–9 are graphs showing radiation patterns that were obtained for the antenna implementation corresponding to the data of FIGS. 6–7.
Figure 9:
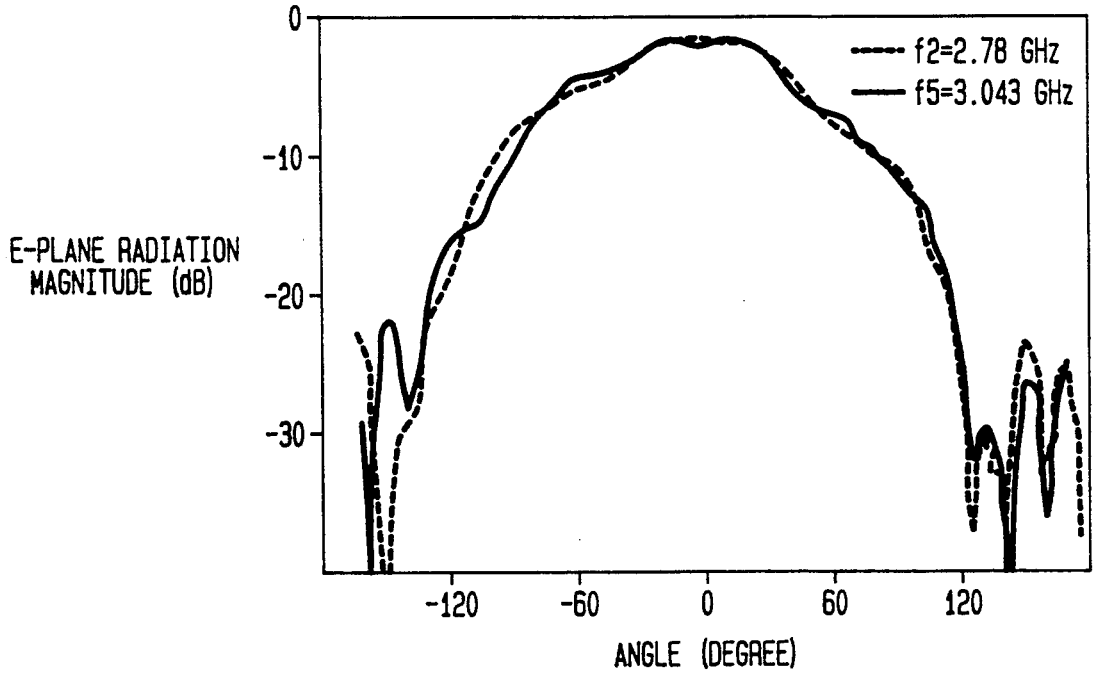

FIGS. 8–9 show the H- and E-plane radiation patterns at the two resonant frequencies f2=2.78 GHz and f5=3.043 GHz for the well-tuned FIG. 6 prototype. During testing, absorbing materials were placed near the edges of ground plane 22 to reduce the edge diffraction for the radiation pattern measurements. It is noted that the pattern at the two different resonant frequencies f2, f5 are almost the same. The wiggly features in these radiation patterns are primarily due to the edge diffraction of the finite ground plane 22. In principle, the radiation patterns should not be affected by modifications of the dielectric layers 24, 25.

Obviously many modifications and variations are possible in the light of the above teachings. For example, the preferred embodiment is directed to a dual-frequency antenna. Clearly, by adding another gap of air or other low dielectric constant material, a three-frequency-band antenna can be achieved. Similarly, each additional dielectric gap will produce another frequency band. Also, the larger the ratio between the dielectric constants of the dielectric materials, viz., dielectric layers 24, 25 and the air of air gap 26, the easier it is to produce a wide range of separation between the frequency bands. Since air has one of the lowest dielectric constants, air gaps, rather than gaps of other low dielectric constant materials, are chosen for the preferred embodiment. Cost and availability also make Duroid 5880 and air preferred choices.

It is therefore to be understood that the invention should not be limited to the exact details of construction shown and described because obvious modifications will occur to a person skilled in the art.

What is claimed is:

1. A multi-band microstrip antenna comprising:

a conductive ground plane;

at least three layers of dielectric material, each of the layers being in contact with said ground plane and being arranged in tandem to form an intermediate layer and two end layers;

a multi-band resonant cavity formed of a conductive material and disposed over the at least three dielectric layers, said resonant cavity having at least three edges contacting said ground plane and sides of the two end dielectric layers and having a lateral opening formed at an end of the resonant cavity for radiating multi-band radiation wherein a width of the resonant cavity is selected such that field distributions of radiant energy in the resonant cavity are sinusoidal in the two end dielectric layers and exponential in the intermediate layer; and cavity feed means for injecting and extracting energy from said cavity.

2. The antenna of claim 1 wherein said cavity has a rectangular cross section.

3. The antenna of claim 2 wherein said intermediate layer has a dielectric constant that is lower than the dielectric constant of said end layers.

4. The antenna of claim 3 wherein the end layers are solid dielectric pieces and said intermediate layer is an air gap.

5. The antenna of claim 4 wherein said cavity feed means includes a probe that extends into said cavity at a point remote from said opening.

6. The antenna of claim 4 wherein said cavity feed means includes a coaxial transmission line having an outer conductor connected to said ground plane and an inner conductor that passes through said cavity and contacts said conductive shell.

7. A dual-band microstrip antenna comprising:

a conductive ground plane;

three layers of dielectric material, each of the layers being in contact with said ground plane and being arranged in tandem to form an intermediate layer and at least two end layers;

a multi-band resonant cavity formed of a conductive material and disposed over the three dielectric layers, said resonant cavity having at least three edges contacting said ground plane and sides of the two end dielectric layers and having a lateral opening formed at an end of the resonant cavity for radiating multi-band radiation wherein a width of the resonant cavity is selected such that field distributions of radiant energy in the resonant cavity are sinusoidal in the two end dielectric layers and exponential in the intermediate layer; and cavity feed means for injecting and extracting energy from said cavity.

8. The antenna of claim 7 wherein said cavity has a rectangular cross section.

9. The antenna of claim 8 wherein the intermediate layer is an air gap.

10. The antenna of claim 8 wherein the two end layers are solid dielectric pieces spaced on either side of an air gap.

11. The antenna of claim 10 wherein said two end layers are made of the same material.

12. The antenna of claim 11 wherein said cavity feed means includes a probe that extends into one of the two end layers.

13. The antenna of claim 13 wherein said cavity feed means includes a coaxial transmission line having an outer conductor connected to said ground plane and an inner conductor that passes through one of the two end layers and contacts said resonant cavity.

* * * * *